United States Patent [19]

von Plessen et al.

[11] 4,032,622

[45] June 28, 1977

[54] METHOD OF CONCENTRATING SULFURIC ACID USING A BOILER OF IMPROVED CAST IRON

[75] Inventors: Helmold von Plessen, Kelkheim, Taunus; Grete Petrich, Liederbach, Taunus, both of Germany

[73] Assignee: Hoechst Aktiengesellschaft, Frankfurt am Main, Germany

[22] Filed: Oct. 27, 1976

[21] Appl. No.: 736,079

Related U.S. Application Data

[63] Continuation of Ser. No. 557,573, March 12, 1975, abandoned.

[30] Foreign Application Priority Data

Mar. 14, 1975 Germany ..... 2412353

[52] U.S. Cl. ..... 423/531; 23/261; 75/123 CB; 75/125; 148/35

[51] Int. Cl.[2] ..... C22C 37/10

[58] Field of Search ..... 423/531; 23/261; 75/125, 123 CB; 148/35

[56] References Cited

UNITED STATES PATENTS

| | | | |
|---|---|---|---|
| 1,729,386 | 9/1929 | Hilton | 75/125 |
| 1,729,387 | 9/1929 | Hilton | 75/125 |
| 2,035,393 | 3/1936 | McCarroll et al. | 75/125 |
| 2,132,276 | 10/1938 | Spalding | 75/125 |
| 2,208,544 | 7/1940 | Lorig | 75/125 |
| 2,354,055 | 7/1944 | Powers | 148/35 |
| 2,485,761 | 10/1949 | Millis | 75/123 CB |
| 3,972,987 | 8/1976 | von Plessen et al. | 423/531 |

OTHER PUBLICATIONS

Metals Handbook, 8th Ed. vol. 1, pp. 349, 360, 361, 1948.

*Primary Examiner*—Arthur J. Steiner
*Attorney, Agent, or Firm*—Curtis, Morris & Safford

[57] ABSTRACT

When distilling or boiling concentrated sulfuric acid in a vessel of gray cast iron the corrosion resistance of the apparatus is improved by using an alloy containing from 0.2 to 1.6 % of silicon
0 to 0.2 % of phosphorus
0.6 to 2.5 % of copper
0 to 3.5 % of nickel besides the usual elements for gray cast iron and a graphite portion in a finely divided form in a pearlitic skeleton.

2 Claims, No Drawings

METHOD OF CONCENTRATING SULFURIC ACID USING A BOILER OF IMPROVED CAST IRON

This is a continuation, of application Ser. No. 557,573 filed Mar. 12, 1975, now abandoned.

The invention relates to a method of using a copper containing gray cast iron as construction material for a vessel for boiling concentrated sulfuric acid.

Dilute and optionally impurified sulfuric acid is often concentrated and optionally purified by the process of H. Pauling first described in German Pat. No. 299,774 (1915). Sulfuric acid of about 70% is introduced into a dephlegmator mounted on a vessel made of gray cast iron. The vessel heated by oil or gas contains sulfuric acid having a degree of purity from 96 to 97% and boiling at a temperature of from 320° to 330° C. The gray cast iron used as engineering material for the boiler has the following composition according to P. Parrish (cf. Gmelins Handbuch, 8th edition, system No. 9, volume sulfur A, page 464):

2.5 – 3.7% of C; 2 to 4% of Si; 0.5 to 0.7% of Mn; 0.07% of S; 0.3 to 0.6% of P; Ni should not be present as alloying constituent.

The gray cast iron boilers of such Pauling installations frequently have a rather varying life time, which not only depends on variations in the composition of the cast material. The invention consequently was concerned with the problem to provide a cast iron for Pauling installations having an improved resistance to concentrated sulfuric acid.

A gray cast iron especially suitable for the preparation of boilers for concentrated sulfuric acid of from 96 to 97%, has now been found containing of from 0.2 to 1.6% of silicon silicium
0 to 0.2% of phosphorus
0.6 to 2.5% of copper
0 to 3.5% of nickel besides the usual alloying elements of gray cast iron and, for the remainder, iron and the graphite portion in a finely divided lamellar form in a pearlitic skeleton. Size, form and dispersion of the graphite particles embedded in the cast material should correspond to approximately D 5 to 7 according to ASTM. The graphite should be embedded in a pearlitic skeleton being as homogenuous as possible. The rest of the usual alloying elements of cast iron should be within the range of the usual contents for cast iron which are: from 2.5 to 3.7% by weight of carbon
0.02 to 0.1% by weight of sulfur
0.2 to 0.7% by weight of manganese
0.04 to 0.2% by weight of chromium
< 0.1% by weight of aluminum
< 0.5% by weight of titanium Especially advantageous for example, are alloyings according to the invention having the following composition: from 2.8 to 3.4% by weight of carbon
0.3 to 0.8% by weight of silicon
0.02 to 0.08% by weight of phosphorus
0.8 to 2.0% by weight of copper
0.1 to 3.0% by weight of nickel
0.02 to 0.1% by weight of sulfur
0.2 to 0.7% by weight of manganese
0.04 to 0.2% by weight of chromium < 0.1% by weight of aluminum
< 0.5% by weight of titanium the remainder being iron.

It was surprising besides the advantageous effect of the copper that the nickel did not show the unfavorable effect expected owing to the quoted passage. Moreover, the indications of some authors (cf. E. Piwowarsky, Hochwertige GuBeisen, Berlin, 1942; O. Tajima, K. Nakao, Techn. Rep. Kansai Univ. 1969) concerning the graphite and silicon content of cast iron could not be confirmed by the cast material according to the invention. The above mentioned alloys may be prepared by the conventional processes for preparing cast iron.

Cast iron having the composition according to the invention exhibited a resistance to corrosion in boiling concentrated sulfuric acid by far superior to a sampling of industrial Pauling boilers. Cast materials of conventional boilers had lamellar graphite structures of from about A 3 to C 3 according to ASTM in a pearlitic skeleton and were composed of from 2.9 to 3.5% of C; 1.6 to 1.9% of Si; 0.2 to 0.6% of P; 0.1 to 0.15% of S; 0.35 to 0.65% of Mn; 0.05 to 0.2% of Cr; 0.04 to 0.08% of Ni; 0.07 to 0.1% of Cu; < 0.03% of Al.

The indicated alloys permit preparing metallic vessels having a high resistancy to sulfuric acid besides a great mechanical resistancy. Problems occurring in the distillation process of concentrated sulfuric acid in vessels of cast iron are treated in details in Frank Rumford
Chemical Engineering Materials,
London 1954, pages 51 – 75
E. Maahn, Brit. Corros. J. 1966, volume 1, page 350
Simmons, Forster, Bowder, Ind.
Chemist and chem. Manufact. 24(1948), 540

Details concerning the construction of boilers of cast iron (especially of Pauling boilers) are likewise known to the expert. Cf.

P. Parrish, Trans. Inst. Chem. Eng.
19, (1941), pages 1 – 24
W. A. M. Edwards, J. H. Clayton,
A. Jackson, BIOS Final Report No. 243, page 17.

The conventional processes for distilling pure and impure sulfuric acid may be realised with the indicated alloys, the wearing of the boiler material only being insignificant.

The comparative corrosion test of a cast iron having the composition according to the invention (sample 2) and of a commercial pearlitic gray cast iron containing finely lamellar graphite (sample 1) showed the more favorable properties of the material according to the invention.

The following example illustrate the invention.

EXAMPLE:

3.9 g of copper sulfate were added to 1 kg of 96% sulfuric acid. This mixture was heated and two samples of gray cast iron having the properties indicated below were added thereto at 260° C. After further heating the mixture obtained until the boiling point was reached, the corrosion mixture was allowed to boil for 24 hours at a temperature of from 315° to 320° C. Both samples were then withdrawn at 270° C, flushed, vigorously rubbed off with a cloth, dried and weighed. The following losses (in weight) due to corrosion were found:

| Sample | % C | % Si | % P | % S | % Mn | % Cr | % Ni | % Cu | % Al % Ti | graphite structure according to ASTM | skeleton |
|---|---|---|---|---|---|---|---|---|---|---|---|
| 1 | 3.3 | 2.3 | 0.61 | 0.14 | 0.47 | 0.075 | 0.032 | 0.056 | Al <0.03 Ti 0.048 | D 7 | mostly pearlitic some ferrite |
| 2 | 3.3 | 0.34 | 0.071 | 0.040 | 0.25 | 0.048 | 2.9 | 1.9 | Al <0.03 Ti <0.02 | D 5 – 6 | pearlitic |

| Sample | surface of the sample $cm^2$ | test time minutes | loss due to corrosion mg | loss due to corrosion $mg/cm^{2 \cdot day}$ |
|---|---|---|---|---|
| 1 | 19.6 | 1450 | 2684 | 136 |
| 2 | 13.3 | 1450 | 411 | 31 |

The material according to the invention (2) compared to the comparative material has a loss due to corrosion inferior by about 77%.

the material according to the invention (2) compared to the comparative material has a loss due to corrosion inferior by about 77%.

What is claimed is:

1. In a process for concentrating sulfuric acid, using a concentrator the improvement wherein the sulfuric acid concentrator has therein sulfuric acid and the concentrator is of gray cast iron which consisting essentially from 2.5 to 3.7% by weight of carbon, 0.2 to 1.6% by weight of silicon, 0.6 to 2.5% by weight of copper, 0 to 0.2% by weight of phosphorous, 0 to 3.5% by weight of nickel, balance iron.

2. The process as defined in claim 1 wherein the sulfuric acid in said concentrator is at boiling point of said acid when said acid is at a concentration of at least 95%.

* * * * *

UNITED STATES PATENT AND TRADEMARK OFFICE

CERTIFICATE OF CORRECTION

PATENT NO. : 4,032,622
DATED : June 28, 1977
INVENTOR(S) : Helmold von Plessen et al.

It is certified that error appears in the above-identified patent and that said Letters Patent are hereby corrected as shown below:

In the Heading, Item [30], change "March 14, 1975" to --March 14, 1974--.

Signed and Sealed this

First Day of November 1977

[SEAL]

*Attest:*

RUTH C. MASON
*Attesting Officer*

LUTRELLE F. PARKER
*Acting Commissioner of Patents and Trademarks*